US006729173B2

(12) United States Patent
Hofele et al.

(10) Patent No.: US 6,729,173 B2
(45) Date of Patent: May 4, 2004

(54) HYDRAULIC DRAW PRESS ARRANGEMENT

(75) Inventors: Hans Hofele, Goppingen (DE); Andreas Lauke, Gruibingen (DE)

(73) Assignee: Schuler Pressen GmbH & Co., Goeppingen (DE)

( * ) Notice: Subject to any disclaimer, the term of this patent is extended or adjusted under 35 U.S.C. 154(b) by 0 days.

(21) Appl. No.: 10/132,154

(22) Filed: Apr. 26, 2002

(65) Prior Publication Data

US 2002/0157443 A1 Oct. 31, 2002

(30) Foreign Application Priority Data

Apr. 27, 2001 (DE) ..... 101 20 841
May 23, 2001 (DE) ..... 101 25 078

(51) Int. Cl.[7] ..... B21D 24/14
(52) U.S. Cl. ..... 72/351; 267/119
(58) Field of Search ..... 72/351; 267/119

(56) References Cited

U.S. PATENT DOCUMENTS 1,774,614 A * 9/1930 Rode ..... 267/119
2,584,339 A * 2/1952 Georgeff ..... 267/119
3,914,978 A * 10/1975 Sekanina et al. ..... 267/119

FOREIGN PATENT DOCUMENTS

DE 44 05 909 A1 8/1995
DE 197 56 911 A1 6/1999
EP 0 417 752 B1 3/1991
EP 0 417 754 B1 3/1991
EP 0887127 12/1998

OTHER PUBLICATIONS

*Inform Feb. 2000*, pp. 54–55.

* cited by examiner

*Primary Examiner*—Lowell A. Larson
(74) *Attorney, Agent, or Firm*—Crowell & Moring LLP

(57) ABSTRACT

A hydraulic drawing system for a press is provided for controlling a blank holder. The blank holder can be moved by at least one hydraulic cylinder-piston unit which has at least one pressure chamber. By way of a connection line, the pressure chamber is connected directly with a control block provided for controlling the movements of the at least one cylinder-piston unit. At least one storage element for storing pressure for the at least one cylinder-piston unit is connected by way of a connection line with the control block and, by way of another connection line at least one valve device is connected with the control block. The connection lines extend in each case at least approximately completely within the respective components.

5 Claims, 4 Drawing Sheets

HYDRAULIC DRAW PRESS ARRANGEMENT

BACKGROUND OF THE INVENTION

This application claims the priority of German Patent Application 101 20 841.3, filed Apr. 27, 2001, and German Patent Application 101 25 078.9, filed May 23, 2001, the disclosures of which are expressly incorporated by reference herein.

The invention relates to a hydraulic drawing system for a press which is provided for controlling a blank holder.

A known hydraulic drawing system is described in the journal *INFORM* 2/2000, Pages 54 to 55. Additional drawing systems of this type are known, for example, from DE 197 56 911 A1, DE 44 05 909 A1, EP 0 417 752 B1, and EP 0 417 754 B1.

With such drawing systems, good drawing results. That is, workpieces of a very high quality, can also be reached on single-acting presses. A problem of the known drawing systems is, however, their relatively slow response as well as the often very high-expenditure construction of the entire system.

SUMMARY OF THE INVENTION

An object of the present invention is, therefore, to provide a hydraulic drawing system for a press which results in a faster response and in a simpler construction of the entire drawing system.

According to the invention, this object is achieved by a system with a first line for directly connecting the pressure chamber with a control block provided for controlling the movements of the at least one cylinder-piston unit, and at least one storage element for storing pressure for the at least one cylinder-piston unit operatively connected by a second line with the control block, and at least one valve device being connected by a third line with the control block, the lines each extending at least approximately completely within respective components.

As a result of the control block, which is connected directly with the pressure chamber of the at least one cylinder-piston unit and which, in addition, has integrated connection lines to the storage element and to the valve device, faster regulating operations are achieved for the at least one cylinder-piston unit, which is directly reflected in shorter response times for the drawing system. Together with the control block, the storage element and the valve device, the at least one cylinder-piston block forms a module-type component in which all control and regulating operations take place for achieving the functions of the drawing system.

This results in a very compact and extremely rigid module which has a by far lower vibration susceptibility than previously known solutions and by means of which a very dynamic regulating behavior can be achieved. Furthermore, this compact construction results in a very easily accessible and, for this reason, mounting- and maintenance-friendly structure of the entire drawing system.

In an advantageous further development of the invention, the required force for the drawing system can be uniformly distributed in that the drawing system is provided with several cylinder-piston units, each cylinder-piston unit having a control block and storage elements mounted on the respective control block as well as valve devices.

BRIEF DESCRIPTION OF THE DRAWINGS

Additional advantageous developments and further developments of the invention are contained in the remaining subclaims as well as in the embodiment illustrated diagrammatically in the following by means of the drawing.

DETAILED DESCRIPTION OF THE DRAWINGS

Figure 1:
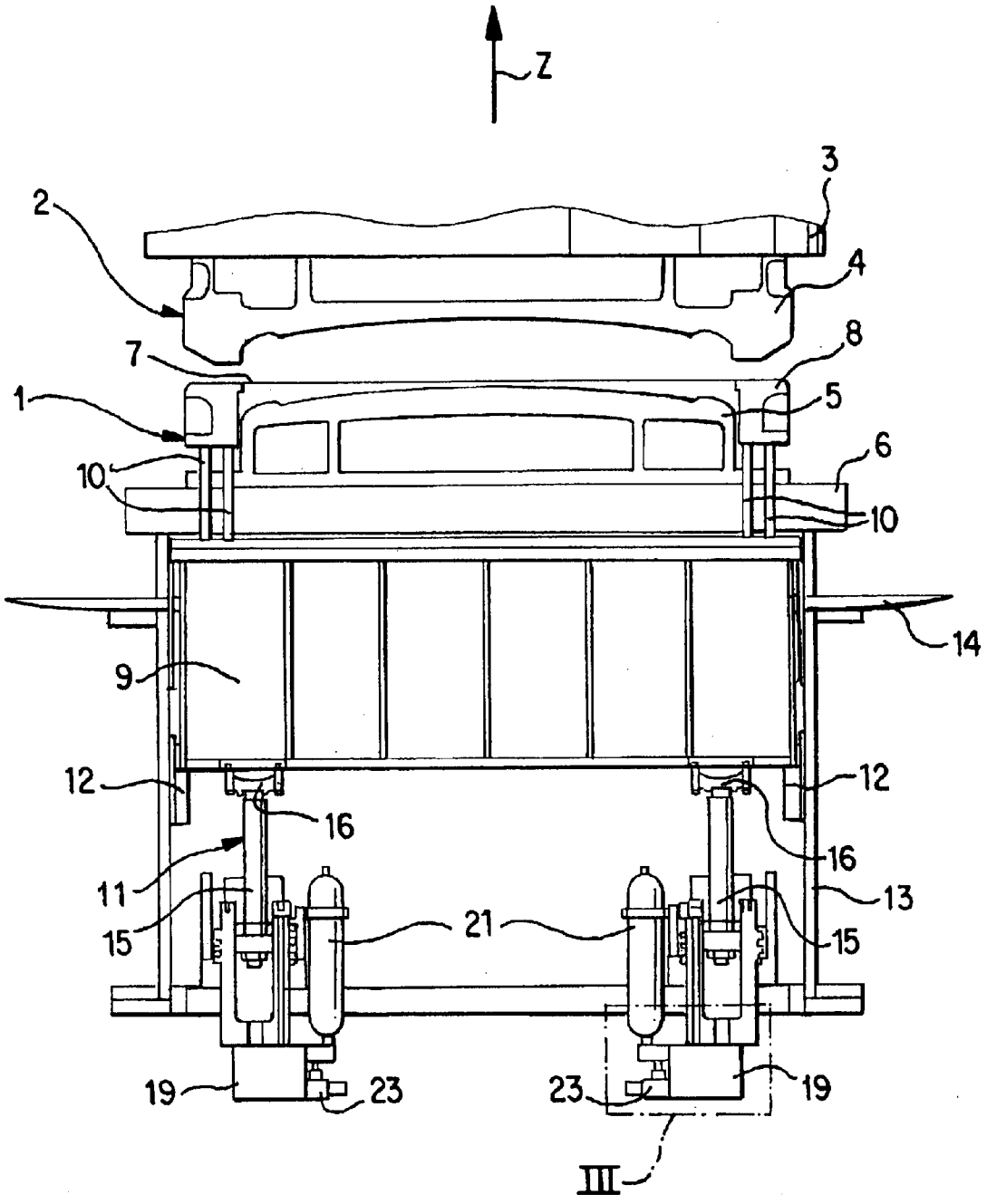
FIG. 1 is a front view of a hydraulic drawing system for a press according to the invention.
Figure 2:
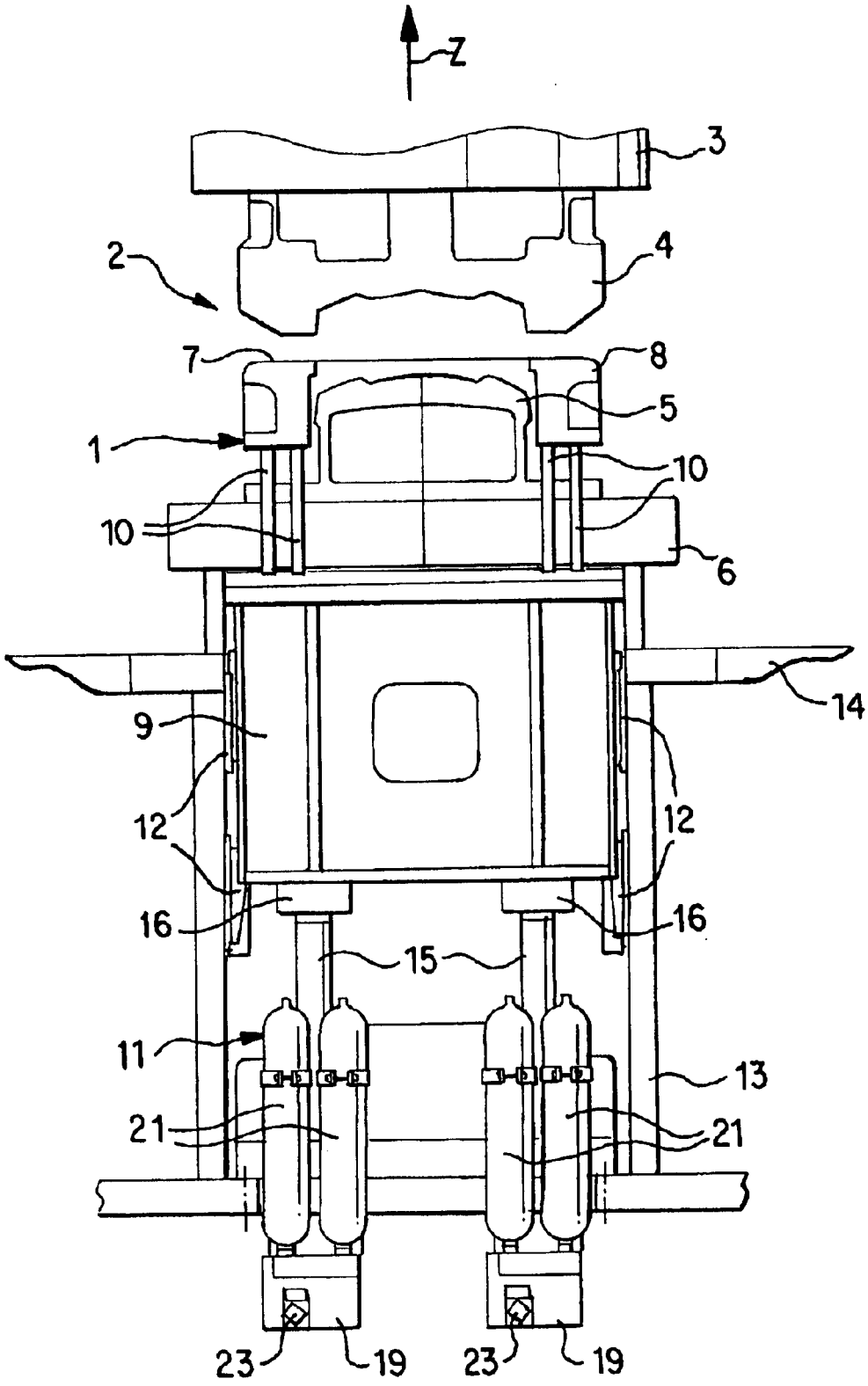
FIG. 2 is a side view of the drawing system of FIG. 1.

FIGS. 1 and 2 illustrate a hydraulic drawing system 1 for a press 2 that can be operated mechanically as well as hydraulically and that has a slide 3 with a top tool 4 mounted thereon. In a manner known per se, the top tool 4 cooperates with a bottom tool 5 which is connected with a sliding table 6. In this manner, a formed workpiece 7 is held by a blank holder 8.

Below the sliding table 6, a pressure box 9 is situated which is connected with the blank holder 8 by press pins 10. The pressure box 9 constructed as a ribbed welded construction can be moved by a hydraulic driving device 11 into the Z-direction and is disposed by laterally arranged guiding elements 12, which in the present embodiment consist of bronze, opposite a press bed 13 which, for the most part, is situated below a floor 14. As an alternative, any other suitable material can also be used for the guiding elements 12.

Figure 3:
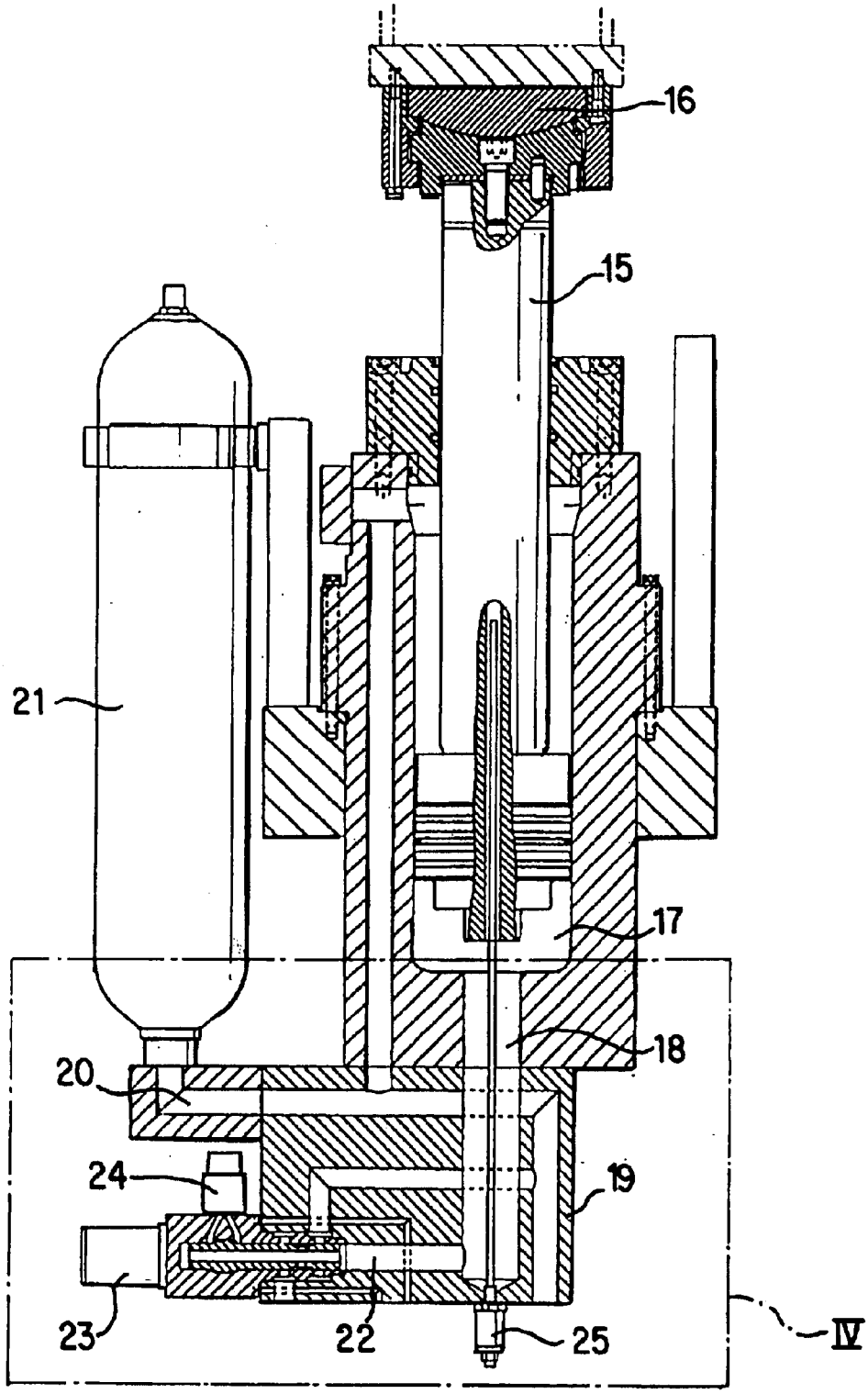
FIG. 3 is an enlarged representation along line III of FIG. 1.
Figure 4:
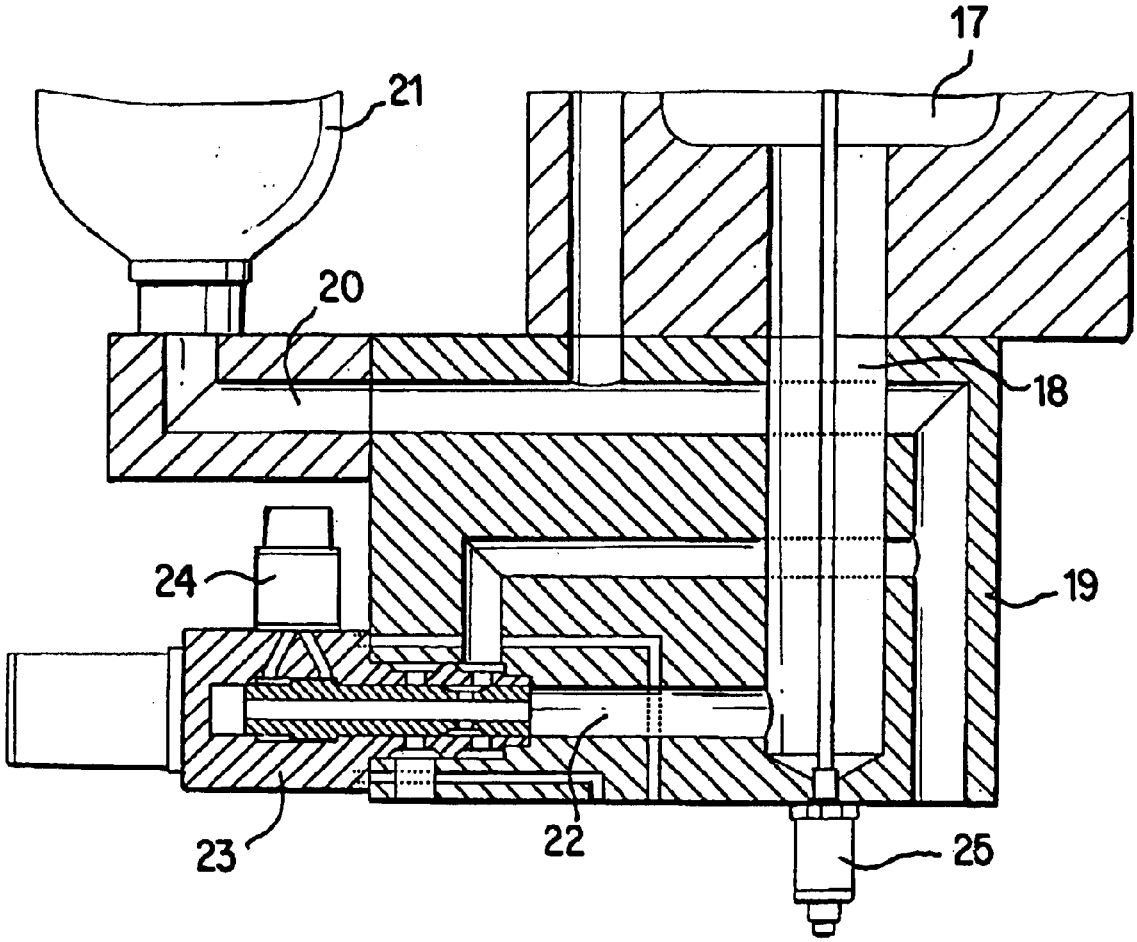
FIG. 4 is an enlarged representation along line IV of FIG. 3.

The construction of the hydraulic driving device 11 is explained by reference to FIG. 3. The hydraulic driving device 11 has four hydraulic cylinder-piston units 15 which are connected by elements 16 with the pressure box 9, such that the pressure box 9 can transmit the force generated in the cylinder-piston units 15 to the press pins 10.

The double-acting cylinder-piston units 15 consisting, for example, of forged steel, each have a pressure chamber 17 which is directly connected by way of a first connection line 18 with a control block 19. Of course, any other number of cylinder-piston units 15 with corresponding pressure chambers 17 may also be provided.

Furthermore, two storage elements 21 respectively, which are provided for the storage of pressure or energy for the pertaining cylinder-piston unit 15, are connected with each control block 19 by way of second connection lines 20, and one valve device 23 respectively is connected by way of third connection lines 22.

In this case, the connection lines 18, 20 and 22 each extend completely within the respective components. That is, the first connection line 18 extends completely in the pressure chamber 17 and in the control block 19; the two second connection lines 20, of which only one need be shown in a sectional view, extend completely within the control block 19 and within the two storage elements 21, and the third connection line 22 extends completely within the control block 19 and the valve device 23.

In the illustrated embodiment, the valve device 23 is constructed as a proportional valve which controls all oil flows within the connection lines 18, 20 and 22 during the upward and downward movements of the pertaining cylinder-piston unit 15.

The storage elements 21 are each constructed as bubble storage devices, are filled with nitrogen as the storage medium, and are used for making available within a short period of time high oil volume flows for the run-up of the drawing system 1. Such storage elements 21 are frequently also called hydraulic storage devices. Instead of bubble storage devices, the storage elements 21 may also be constructed as piston-type storage devices of a construction known per se.

Furthermore, a pilot valve 24 is mounted on the valve device 23, and the control block 19 is provided with a linear converter 25.

In the manner described above, a respective module-type construction is created for the hydraulic driving device 11, which results in a high mounting- and maintenance-friendliness. Furthermore, as a result of the shortness of the connection lines 18, 20 and 22, a lower flow pressure loss and therefore shorter regulating times can be achieved.

Within this module-type component consisting of the cylinder-piston unit 15, the control block 19, the storage elements 21 and the valve device 23, all active control and regulating operations take place for achieving the functions of the drawing system 1 described in the following. Each module-type component configured in this manner represents an independently acting unit, in which case the required drawing force is achieved by the combination of several such modules consisting of the cylinder-piston unit 15, the control block 19, the storage elements 21 and the valve device 23. It should be noted in this context, however, that very short line elements, which may possibly extend between the individual elements of the module-type component do not significantly impair the function of the drawing system.

Of course, an electronic control is also provided for the drawing system 1 which is, however, not shown for ease of understanding because its construction is known per se. This electronic control can also take over the synchronization of the individual above-described modules.

During a slide stroke of the press 3, a pre-acceleration of the drawing system 1 and of the blank holder 8 first takes place with respect to the top tool 4, whereby the hardness of the impact between the blank holder 8 and the top tool 4 is damped. As a result, the quality of the workpieces 7 is improved. The useful life of the top tool 4, of the bottom tool 5, of the drawing system 1 and of the entire press 3 is thereby increased. In addition, a reduction of the noise emission is achieved. It is, however, possible to do without the pre-acceleration and remains within the scope of the present invention.

As soon as the top tool 4 is fitted on the blank holder 8, the drawing force will build up. The physically-caused elasticity of the entire system, particularly of the oil column in the pressure chamber 17, leads to a certain path which is required for building up the drawing force. Because of the abovedescribed construction of the hydraulic driving device 11 with the control blocks 19 and the integrated connection lines 18, 20, and 22, the maximal drawing force in the case of the present embodiment can already be reached after at most 24 mm. Even if the above-described pre-acceleration does not take place, the pressure buildup will nevertheless be required.

During the subsequent drawing operation of the workpiece 7, the latter is formed between the top tool 4 and the bottom tool 5 and, in the process, is held by a certain force by the blank holder 8. As a result of the displacement of oil from the pressure chamber 17, the drawing system 1 supplies this force, which is controlled by the above-described valve device 23. In this case, the oil pressure in the cylinder-piston unit 15 is continuously measured by a pressure sensor (not shown), and is compared with a desired value. According to the deviation from the desired value, the valve device 23 is then opened more or less far. In this case, it is contemplated that the blank holding force be kept either continuously constant or to define it in the form of a pressure profile with a linear interpolation. Such a pressure profile can be programmed individually for each cylinder-piston unit 15.

In order to avoid a deformation of the finished workpiece during a spring-back of the drawing system 1 as a result of holding-down devices or ejectors possibly present in the top tool 4, the drawing device 1 is actively pulled downward in its lower dead center. The further course of the production of the workpieces 7, such as the ejection and reception of a new part, is know per se and will therefore not be explained in detail.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Press hydraulic drawing system for controlling a movable blank holder, comprising at least one double-acting hydraulic cylinder-piston unit having upper and lower chambers connectable to a common system pressure, a first line for directly connecting the upper chamber with a control block and the common system pressure provided for controlling the movements of the at least one cylinder-piston unit, and at least one storage element for storing the system common pressure for the at least one cylinder-piston unit operatively connected by a second line with the control block, and at least one valve device being connected by a third line with the control block and the lower chamber, the lines each extending at least approximately completely within respective components.

2. The system according to claim 1 wherein a plurality of cylinder-piston units are provided, each having a control block, and storage elements and valve devices mounted on the respective control block.

3. The system according to claim 1, wherein the storage element is a nitrogen bubble storage device.

4. The system according to claim 1, wherein the at least one valve device is configured as a proportional valve.

5. The system according to claim 1, wherein the blank holder is arranged to undergo a pre-acceleration with respect to an upper tool during a press slide stroke.

* * * * *